United States Patent [19]

Elias

[11] 4,190,922

[45] Mar. 4, 1980

[54] BATHTUB MOP

[76] Inventor: Pauline Elias, 202 W. 10th St., Bristow, Okla. 74010

[21] Appl. No.: 963,984

[22] Filed: Nov. 27, 1978

[51] Int. Cl.[2] ..... A47L 13/46; A46B 5/02

[52] U.S. Cl. ..... 15/244 A; 15/144 R; 15/145

[58] Field of Search ..... 15/144 R, 144 A, 145, 15/147 A, 147 B, 147 C, 209 D, 228, 229 B, 229 BP, 229 BW, 244 R, 244 A

[56] References Cited

U.S. PATENT DOCUMENTS

| | | | |
|---|---|---|---|
| 1,708,052 | 4/1929 | Channell | 15/229 B X |
| 3,007,730 | 11/1961 | Mills | 15/144 R X |
| 3,178,748 | 4/1965 | Heepe | 15/244 R |
| 3,214,779 | 11/1965 | Wheeler | 15/244 A |
| 3,491,397 | 1/1970 | Hesener | 15/244 A X |
| 3,991,431 | 11/1976 | Thielen | 15/147 A |

FOREIGN PATENT DOCUMENTS

| | | | |
|---|---|---|---|
| 37668 | 7/1927 | Denmark | 15/244 A |
| 1065583 | 9/1959 | Fed. Rep. of Germany | 15/244 A |
| 1110749 | 10/1955 | France | 15/244 A |
| 258806 | 5/1949 | Switzerland | 15/209 D |
| 9915 | of 1904 | United Kingdom | 15/244 A |

*Primary Examiner*—Edward J. McCarthy
*Attorney, Agent, or Firm*—Head & Johnson

[57] ABSTRACT

A bathtub mop comprising an elongated handle having a replaceable cleaning element or the like pivotally secured to one end thereof for conforming to the contour of the inner periphery of the bathtub during a cleaning operation. The cleaning element is removably secured to the outer end of the handle for ease of replacement, and is suitably reinforced to provide sufficient rigidity for efficient use while retaining sufficient flexibility for following the contour of the tub.

4 Claims, 3 Drawing Figures

BATHTUB MOP

BACKGROUND OF THE INVENTION

1. Field of the Invention

This invention relates to improvements in cleaning devices and more particularly, but not by way of limitation, to a mop for facilitating the cleaning of the interior of a bathtub.

2. Description of the Prior Art

The cleaning of the interior of a bathtub has long been a problem in that the location of the tub is normally at floor level, and the person cleaning the tub must kneel or otherwise position himself in the proximity of the bottom of the tub in oder to physically engage the tube with the usual cleaning sponges, rags, or the like normally used for the cleaning operation. While in this kneeling or stooping position, the cleaning person must also bend or contort his body for reaching the far sides of the tub in a manner for producing sufficient pressure thereagainst for an efficient scrubbing thereof. All in all the operation is normally difficult and unpleasant.

In order to alleviate the difficulties of the tub cleaning operation many bathtub cleaning devices have been developed, such as that shown in the G. C. Wheeler U.S. Pat. No. 3,214,779. This device has certain disadvantages, however, in that structure of the cleaning element is somewhat expensive, and the ball and socket arrangement securing the cleaning element to the handle member may accidentally become disengaged during the application of sufficient pressure for an efficient cleaning operation.

SUMMARY OF THE INVENTION

The present invention contemplates a novel bathtub mop which has been particularly designed and constructed for overcoming the foregoing disadvantages. The novel mop comprises an elongated handle member having a pivotal cleaning element removably secured to one end thereof. The handle is sufficiently long for facilitating the pressing of the cleaning element against the interior of the tub from a substantially erect or standing position of the cleaning person. The cleaning element is preferably a sponge having sufficient reinforcement for rigidity while retaining the flexibility of the sponge in order that the sponge will conform to the configuration or contours of the inner periphery of the tube during a cleaning operation. An inverted, substantially U-shaped connection member is provided on the sponge for releasable engagement with a catch member secured to the outer end of the handle. The connection member may be easily engaged with the catch member for installing the sponge element on the handle, and the catch member is particularly designed for substantially precluding accidental disconnection of the sponge element therefrom. When the sponge is to be removed from the handle for any reason, such as for replacement, the catch member may be easily manually released for permitting the disengagement of the connection member with the catch member. The novel mop is simple and efficient in operation and economical and durable in construction.

DESCRIPTION OF THE PREFERRED EMBODIMENT

Figure 1:
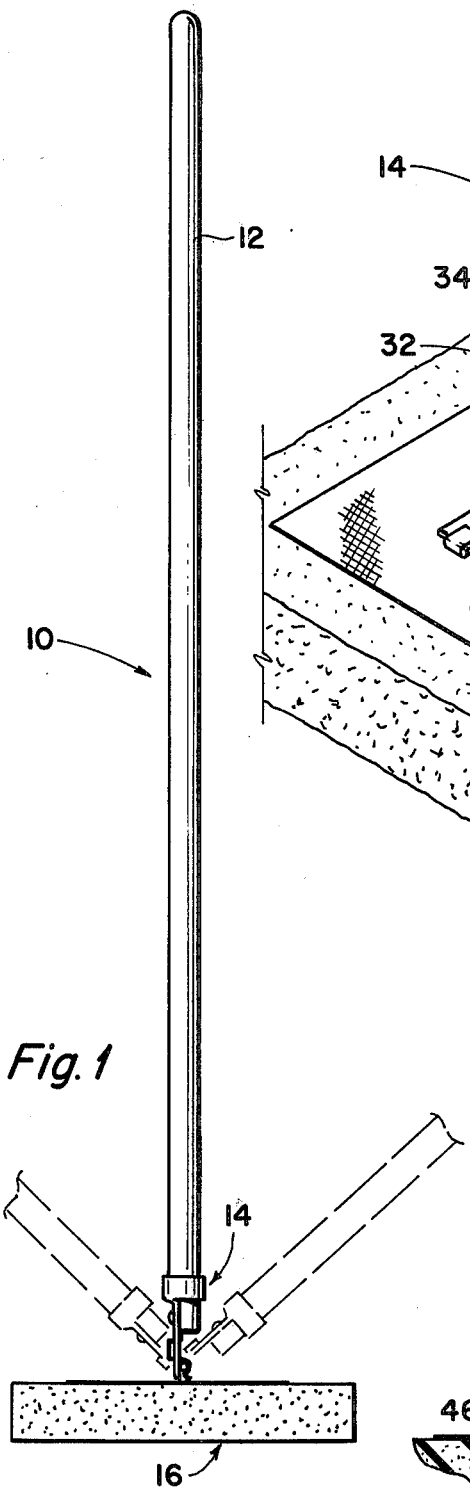
FIG. 1 is a side elevational view of a bathtub mop embodying the invention, with alternate operational positions thereof depicted in broken lines for purposes of illustration.
Figure 2:
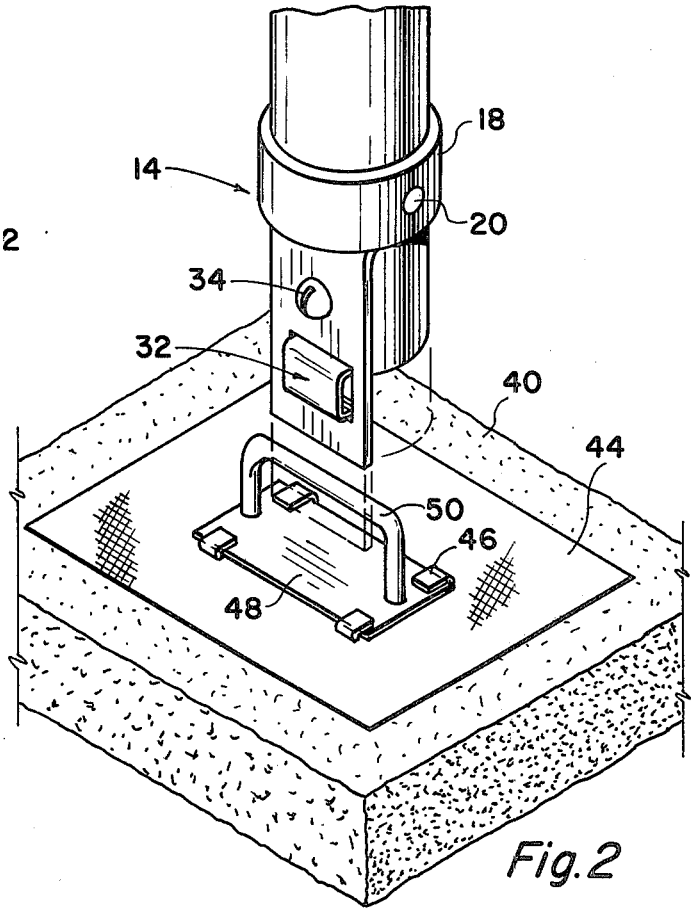
FIG. 2 is an enlarged perspective view of the lower end of the handle and a portion of the sponge element utilized in a bathtub mop embodying the invention.

Referring to the drawings in detail, reference character 10 generally indicates a bathtub mop comprising an elongated handle member 12 having a catch element 14 secured to one end thereof in a manner as will be hereinafter set forth. A cleaning element 16 is removably secured to the catch element 14 and is pivotal thereabout for facilitating a bathtub cleaning operation while the cleaning person remains in a substantially upright or erect position.

The catch member 14 comprises a sleeve 18 having an inner diameter substantially equal to the outer diameter of the handle 12 for receiving the handle therethrough. The collar 18 may be secured to the handle 12 in the proximity of the outer end thereof in any suitable manner, such as by a transversely extending pin 20, or the like, as is well known. A strap member 22 extends axially outwardly from the collar 18 and is preferably integral therewith but not limited thereto. The strap 22 preferably includes a rearwardly extending shoulder portion 24 (FIG. 3) terminating in a recessed downwardly extending portion 26, as viewed in the drawings, with said shoulder portion 24 and recessed portion 26 being disposed adjacent a corresponding recess 28 provided on the outer periphery of the handle 12. The strap is further provided with an aperture 30 spaced from the shoulder 24 for a purpose as will be hereinafter set forth.

Figure 3:
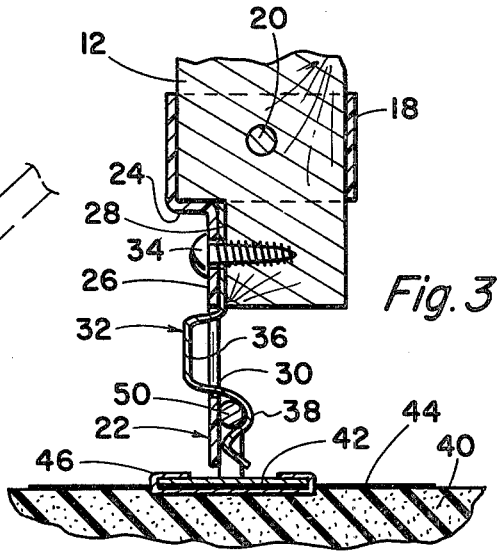
FIG. 3 is a sectional elevational view of the lower end of the handle and a portion of the sponge element utilized in a bathtub mop embodying the invention.

A spring member 32 is interposed between the recessed portion 26 of the strap 22 and the recess 28 of the handle 14, as particularly shown in FIG. 3, and the strap 22 and spring 32 are preferably secured to the recess 28 by a suitable wood screw 34, or the like, which extends through both the strap 22 and spring 32 and into the handle 12. The spring 32 is provided with a substantially C-shaped portion 36 which normally extends through the aperture 30, and which terminates in a rearwardly extending arcuate clasp member 38 which extends away from the strap 22 in an opposite direction with respect to the portion 36. The spring 32 is designed for constantly urging the C-shaped member 36 in a direction extending through the aperture 30, and is sufficiently yieldable for being removed from the aperture upon the application of sufficient manual pressure thereagainst as will be hereinafter set forth.

The cleaning element 16 comprises a scouring pad 40 of any suitable configuration, such as substantially rectangular, and preferably constructed of a suitable sponge material, but not limited thereto. A reinforcing element 42, preferably constructed of a suitable metallic material, is embedded within one flat surface of the scouring pad 40 as particularly shown in FIG. 3, and may be secured therein by a suitable flexible sheet 44 which may be cemented or otherwise secured to the outer surface of said one flat surface of the scouring pad 40. It is preferable that the reinforcing element 42 be provided with a plurality of clip members 46 which extend outwardly through the sheet 44 for slidably receiving the side edges of a plate member 48 therein. The plate member 48 may be constructed of a suitable plastic material, metal, or the like, and is provided with an inverted substantially U-shaped bar 50 either integral therewith or secured to the outer face thereof in any suitable manner (not shown) and removably engageable with the clasp member 38 for pivotally and removably securing the scouring pad 40 to the handle 12. The opposite side edges of the plate 48 may be slightly bent for embedding into the surface of the pad 40 and cemented or glued thereto, if desired, in lieu of the clip members 46.

In use, the scouring pad 40 may be secured to the plate 48 by sliding the plate 48 between the complementary clips 46 as is well known. The clips 46 are sufficiently tightly engaged with the plate 48 for securely retaining the scouring pad 40 thereon, but permitting release of the pad 40 therefrom when it is necessary or desired to remove the pad for any reason, such as for replacement thereof. The bar 50 may then be removably secured to the catch member 14 by manually depressing the C-shaped element 36 sufficiently for moving the clasp member 38 in a direction away from the strap 22. In this position, the bar 50 may be inserted between the clasp 38 and the strap 22, and upon release of the manual pressure against the element 36, the clasp 38 will securely retain the bar in connection with the catch member 14. The cross-sectional configuration of the bar 50 is substantially circular, and the complementary arcuate configuration of the clasp member 28 provides a pivotal connection between the bar 50 and the catch member 14 whereby the scouring pad 40 may be pivotally moved with respect to the handle 12 during a bathtub cleaning operation.

The handle 12 may be manipulated from the outer end thereof while the cleaning person is in a standing of substantially erect position and in such a manner that the outer surfaces of the scouring pad 40 may be pressed against the inner periphery of the tub (not shown) to be cleaned. The pivotal connection between the pad 40 and the handle 12, and the flexible construction of the pad 40 cooperate for providing a cleaning surface which conforms substantially to the contours of the inner periphery of the bathtub for providing an efficient cleaning thereof.

When the scouring pad 40 is to be removed for any reason, the element 36 may be manually depressed sufficiently for permitting removal of the bar 50 therefrom. The plate 48 may then be removed from connection with the clips 46, and the pad 40 may be removed and/or replaced, as desired. Of course, it will be apparent that the pad 40 may be removed from connection with the plate 48 without removal of the bar 50 from the clasp 38, if desired. In the event the plate 48 is cemented or glued to the pad 40, of course the plate may be discarded with the scouring pad.

From the foregoing, it will be apparent that the present invention provides a novel bathtub mop comprising an elongated handle having a pivotal scouring pad removably secured to one end thereof whereby the interior of a bathtub may be efficiently cleaned while the cleaning person remain in a substantially upright or erect position. The novel scouring pad is sufficiently flexible for conforming to the contour of the inner periphery of the tub, and sufficiently reinforced to provide an efficient scouring action. The pad may be quickly and easily removed from connection with the handle for ease of replacement.

Whereas the present invention has been described in particular relation to the drawings attached hereto, it should be understood that other and further modifications apart from those shown or suggested herein may be made within the spirit and scope of this invention.

What is claimed is:

1. A bathtub cleaning mop comprising an elongated handle, scouring pad means disposed at one end of said handle, catch means secured to said one end of the handle and having yieldable releasable clasp means having a normal closed position and being openable upon the application of sufficient pressure thereagainst, and removable bar means provided on said scouring pad means and alternately engagable and disengagable with said clasp means upon the application of pressure against the clasp for removably securing said scouring pad means to the clasp means.

2. A bathtub cleaning mop as set forth in claim 1 wherein the scouring pad means comprises a reinforced flexible scouring pad, and clip means provided on one face of said scouring pad for removably securing said bar means thereto.

3. A bathtub cleaning mop as set forth in claim 2 wherein the bar means is of an inverted substantially U-shaped configuration.

4. A bathtub cleaning mop as set forth in claim 1 wherein the catch means comprises a sleeve secured in the proximity of said one end of the handle, a strap member extending axially outwardly from said sleeve member, a spring member interposed between the handle and the strap member and having a substantially C-shaped element provided therein, means securing both the strap member and spring member to the handle member, said strap member being provided with an aperture for receiving a portion of the spring member therethrough, said spring member being provided with an arcuate clasp member at the outer end thereof extending in an opposite direction from the C-shaped element and responding to sufficient manual pressure against said C-shaped element for moving in a direction away from said strap member for receiving the bar means therein for pivotally and removably securing the bar means to the handle.

* * * * *